US010601161B2

(12) United States Patent
Pan et al.

(10) Patent No.: US 10,601,161 B2
(45) Date of Patent: Mar. 24, 2020

(54) CONNECTION TERMINAL

(71) Applicant: Tyco Electronics (Shanghai) Co. Ltd., Shanghai (CN)

(72) Inventors: Lei Pan, Shanghai (CN); Pai Rajendra, Bangalore (IN); Tongbao Ding, Shanghai (CN); Huigang Guo, Shanghai (CN); Xing Tong, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 16/299,768

(22) Filed: Mar. 12, 2019

(65) Prior Publication Data

US 2019/0288427 A1 Sep. 19, 2019

(30) Foreign Application Priority Data

Mar. 13, 2018 (CN) ..... 2018 2 0340362 U

(51) Int. Cl.
*H01R 13/20* (2006.01)
*H01R 4/18* (2006.01)
*H01R 13/115* (2006.01)

(52) U.S. Cl.
CPC ..... *H01R 13/20* (2013.01); *H01R 4/185* (2013.01); *H01R 13/115* (2013.01)

(58) Field of Classification Search
CPC ..... H01R 13/20; H01R 13/115
See application file for complete search history.

(56) References Cited

U.S. PATENT DOCUMENTS 2,945,206 A * 7/1960 Hammell ..... 439/881
3,096,136 A * 7/1963 Batcheller ..... H01R 4/188 439/881
3,123,431 A * 3/1964 Keller ..... H01R 4/185 439/881
3,546,664 A * 12/1970 De Bolt ..... H01R 13/115 439/866
3,577,119 A * 5/1971 Delyon ..... H01R 4/184 439/881
3,644,872 A * 2/1972 Russo, Jr. ..... H01R 13/115 439/849
3,771,111 A * 11/1973 Pritulsky ..... H01R 13/115 439/850
3,976,348 A * 8/1976 Simmons ..... H01R 11/00 439/268

(Continued)

*Primary Examiner* — Ross N Gushi
(74) *Attorney, Agent, or Firm* — Barley Snyder

(57) ABSTRACT

A connection terminal comprises a receptacle part, a crimping part, and a connection part connected between the receptacle part and the crimping part. The crimping part includes a conductor crimping part adapted to be crimped on a conductor of a wire and an outer layer crimping part adapted to be crimped on an outer layer of the wire. The conductor crimping part includes a first conductor crimping part and a second conductor crimping part which are spaced from each other by an interval in a lateral direction perpendicular to the longitudinal direction. The receptacle part includes an elastic latch adapted to lock a plug inserted into the receptacle part and located at a rear end of the receptacle part close to the crimping part. The elastic latch is positioned between the first conductor crimping part and the second conductor crimping part in the lateral direction.

19 Claims, 1 Drawing Sheet

(56) References Cited

U.S. PATENT DOCUMENTS

RE30,277 E * 5/1980 Simmons ..... H01R 11/00 439/268
4,298,243 A * 11/1981 Swengel, Jr. ..... H01R 13/115 439/730
4,348,070 A * 9/1982 Simon ..... H01R 13/50 439/586
RE31,142 E * 2/1983 Simmons ..... H01R 11/00 439/586
4,415,221 A * 11/1983 Inoue ..... H01R 13/20 439/849
4,421,375 A * 12/1983 Coldren ..... H01R 4/2462 439/423
4,423,921 A * 1/1984 Hall ..... H01R 13/115 439/849
4,534,613 A * 8/1985 Esser ..... H01R 13/20 439/834
4,558,913 A * 12/1985 Goto ..... H01R 13/115 439/268
4,566,747 A * 1/1986 Peers ..... H01R 13/20 439/270
4,579,409 A * 4/1986 Enneper ..... H01R 13/20 439/266
4,679,887 A * 7/1987 Jackson ..... H01R 13/20 439/849
4,685,754 A * 8/1987 Coldren ..... H01R 13/20 439/270
4,696,530 A * 9/1987 Vandame ..... H01R 13/113 439/266
4,934,966 A * 6/1990 D'Urso ..... H01R 13/20 439/849
5,044,972 A * 9/1991 Ikeda ..... H01R 13/4223 439/268
5,203,726 A * 4/1993 Quinn ..... H01R 4/20 439/867
5,269,699 A * 12/1993 Peloza ..... H01R 13/432 439/268
5,322,460 A * 6/1994 Hass ..... H01R 13/115 439/849
5,525,070 A * 6/1996 Axelsson ..... H01R 13/633 439/268
5,667,414 A * 9/1997 Karacora ..... H01R 4/2454 439/397
5,722,925 A * 3/1998 Kameyama ..... H01R 13/113 600/453
6,039,615 A * 3/2000 Suzuki ..... H01R 13/113 439/849
6,428,365 B1 * 8/2002 Yamamoto ..... H01R 13/113 439/843
6,527,600 B2 * 3/2003 Alonso Merino ... H01R 13/113 439/842
6,544,079 B2 * 4/2003 Renkes ..... H01R 13/20 439/848
6,544,080 B1 * 4/2003 Yamamoto ..... H01R 13/113 439/849
6,837,745 B2 * 1/2005 Takada ..... H01R 13/562 439/521
6,997,746 B2 * 2/2006 Taylor ..... H01R 4/183 439/585
7,198,526 B1 * 4/2007 MacNeil ..... H01R 4/185 439/881
7,255,614 B1 * 8/2007 Irish ..... H01R 13/113 439/849
7,677,934 B2 * 3/2010 Piovesan ..... H01R 13/112 439/818
8,057,261 B1 * 11/2011 DeSio ..... H01R 13/506 439/625
9,009,962 B2 * 4/2015 Sugie ..... H01R 13/03 29/870
9,318,818 B2 * 4/2016 Nakamura ..... H01R 13/111
9,397,419 B2 * 7/2016 Kang ..... H01R 12/53
9,509,066 B2 * 11/2016 Sasano ..... H01R 4/48
9,692,163 B1 * 6/2017 Didonato ..... H01R 4/70
9,876,292 B1 * 1/2018 Jacques ..... H01R 4/185
10,027,037 B2 * 7/2018 Didonato ..... H01R 4/48
10,079,440 B1 * 9/2018 Didonato ..... H01R 4/48
10,164,366 B2 * 12/2018 Kataoka ..... H01R 13/113
10,193,259 B1 * 1/2019 Didonato ..... H01R 13/424
10,211,558 B1 * 2/2019 Didonato ..... H01R 13/115
2009/0036004 A1 * 2/2009 Bowen ..... H01R 13/115 439/849
2013/0052889 A1 * 2/2013 Shen ..... H01R 4/184 439/890
2019/0288427 A1 * 9/2019 Pan ..... H01R 13/20
2019/0288428 A1 * 9/2019 Pan ..... H01R 13/20

* cited by examiner

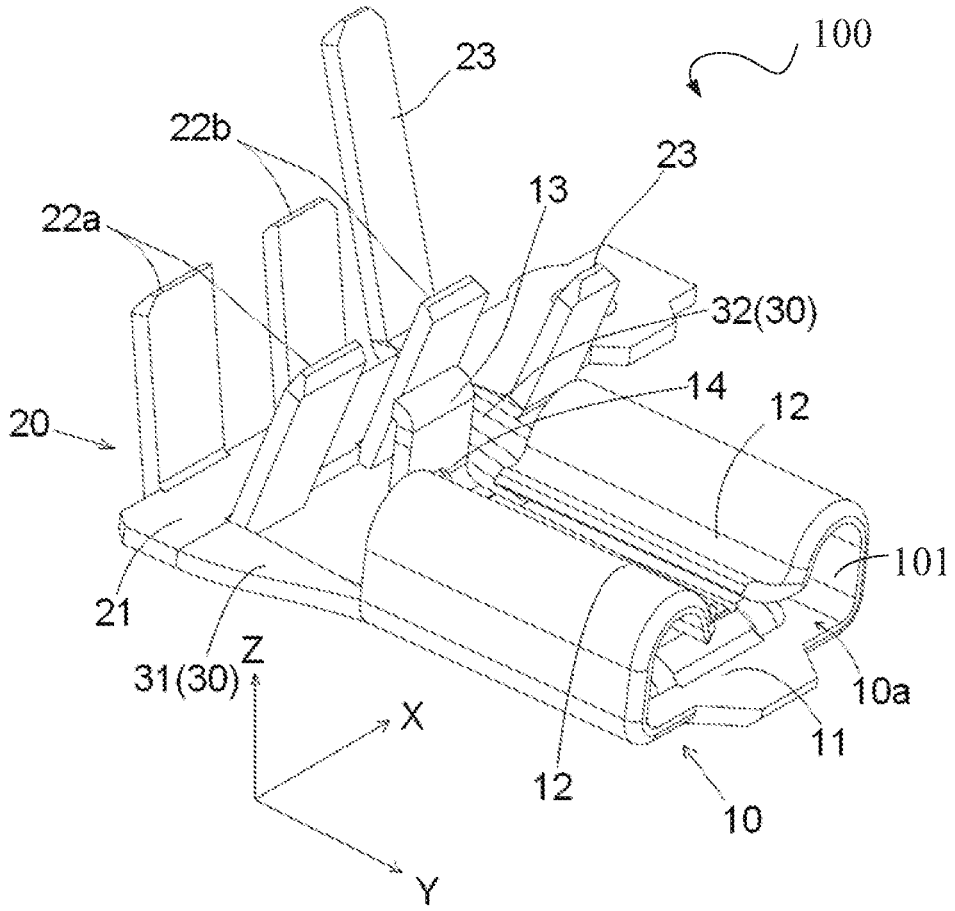
100
23
22b
23
13
22a
32(30)
14
12
20
101
21
31(30)
Z
X
10a
11
12
10
Y

CONNECTION TERMINAL

CROSS-REFERENCE TO RELATED APPLICATION

This application claims the benefit of the filing date under 35 U.S.C. § 119(a)-(d) of Chinese Patent Application No. 201820340362.9, filed on Mar. 13, 2018.

FIELD OF THE INVENTION

The present invention relates to a connection terminal and, more particularly, to a connection terminal having a receptacle part and a crimping part.

BACKGROUND

A connection terminal generally includes a receptacle part located at a first end of the connection terminal in a longitudinal direction, a crimping part located at a second end of the connection terminal in the longitudinal direction, and a connection part connected between the receptacle part and the crimping part. The receptacle part is adapted to mate with a plug so as to be electrically connected therewith. The crimping part is adapted to be crimped on a wire so as to be electrically connected therewith. The crimping part generally includes a conductor crimping part adapted to be crimped on a conductor of the wire and an outer layer crimping part adapted to be crimped on an outer layer of the wire. The receptacle part generally includes an elastic latch adapted to lock the plug inserted into the receptacle part and located at a rear end of the receptacle part.

The conductor crimping part of the crimping part is generally arranged outside of the receptacle part in a lateral direction so as to be staggered with the elastic latch, thereby preventing the conductor crimping part from interfering with the elastic latch. Such a design does not increase a longitudinal dimension of the connection terminal, but increases a lateral dimension of the connection terminal, which is detrimental to miniaturization of the connection terminal.

SUMMARY

A connection terminal comprises a receptacle part, a crimping part, and a connection part connected between the receptacle part and the crimping part. The crimping part includes a conductor crimping part adapted to be crimped on a conductor of a wire and an outer layer crimping part adapted to be crimped on an outer layer of the wire. The conductor crimping part includes a first conductor crimping part and a second conductor crimping part which are spaced from each other by an interval in a lateral direction perpendicular to the longitudinal direction. The receptacle part includes an elastic latch adapted to lock a plug inserted into the receptacle part and located at a rear end of the receptacle part close to the crimping part. The elastic latch is positioned between the first conductor crimping part and the second conductor crimping part in the lateral direction.

BRIEF DESCRIPTION OF THE DRAWINGS

The invention will now be described by way of example with reference to the accompanying Figures, of which:

FIG. 1 is a perspective view of a connection terminal according to an embodiment.

DETAILED DESCRIPTION OF THE EMBODIMENT(S)

The technical solution of the present disclosure will be described hereinafter in further detail with reference to the following embodiments, taken in conjunction with the accompanying drawings. In the specification, the same or similar reference numerals indicate the same or similar parts. The description of the embodiments of the present disclosure hereinafter with reference to the accompanying drawings is intended to explain the general inventive concept of the present disclosure, and should not be constructed as a limitation to the present disclosure.

In addition, in the following detailed description, for the sake of explanation, numerous specific details are set forth in order to provide a thorough understanding of the disclosed embodiments. It will be apparent, however, one or more embodiments may also be practiced without these specific details. In other instances, well-known structures and devices are illustrated schematically in order to simplify the drawing.

A connection terminal 100 according to an embodiment, as shown in FIG. 1, comprises a receptacle part 10, a crimping part 20, and a connection part 30. The receptacle part 10 is disposed at a first end of the connection terminal 100 in a longitudinal direction Y and configured to mate with a plug inserted into the receptacle part 10. The crimping part 20 is disposed at a second end of the connection terminal 100 in the longitudinal direction Y opposite the first end and configured to be crimped on a wire. The connection part 30 is connected between the receptacle part 10 and the crimping part 20. In an embodiment, the connection terminal 100 is an integrated piece formed of a single metal sheet, for example, a copper sheet.

The crimping part 20, as shown in FIG. 1, includes a conductor crimping part adapted to be crimped on a conductor of the wire and an outer layer crimping part 23 adapted to be crimped on an outer layer of the wire. The receptacle part 10 includes an elastic latch 13 adapted to lock the plug inserted into the receptacle part 10 and located at a rear end of the receptacle part 10 close to the crimping part 20.

As shown in FIG. 1, the conductor crimping part includes a first conductor crimping part 22*a* and a second conductor crimping part 22*b* which are spaced from each other by an interval in a lateral direction X perpendicular to the longitudinal direction Y. The elastic latch 13 is positioned between the first conductor crimping part 22*a* and the second conductor crimping part 22*b*; a projection of the elastic latch 13 in the longitudinal direction Y is positioned in the interval between the first conductor crimping part 22*a* and the second conductor crimping part 22*b*. The elastic latch 13 is thereby prevented from interfering with the conductor crimping part during forming them, and also does not increase both the longitudinal and lateral dimensions of the connection terminal 100, which is beneficial to the miniaturization of the connection terminal 100.

The crimping part 20, as shown in FIG. 1, includes a base 21 extending in the lateral direction X. The base 21 connects the first conductor crimping part 22*a*, the second conductor crimping part 22*b*, and the outer layer crimping part 23. The base 21 has a pair of opposite sides in the longitudinal direction Y. The first conductor crimping part 22*a* includes a pair of first conductor crimping wings located on the two opposite sides of the base 21. The second conductor crimping part 22*b* includes a pair of second conductor crimping wings located on the two opposite sides of the base 21. The outer layer crimping part 23 includes a pair of outer layer crimping wings located on the two opposite sides of the base 21.

As shown in FIG. 1, the connection part 30 includes a first connection part 31 and a second connection part 32 which are arranged at a pair of opposite sides of the receptacle part 10 in the lateral direction X. The first conductor crimping part 22*a*, the second conductor crimping part 22*b*, and the elastic latch 13 are positioned between the first connection part 31 and the second connection part 32 in the lateral direction X. The second connection part 32 is positioned between the second conductor crimping part 22*b* and the outer layer crimping part 23 in the lateral direction X.

The first connection part 31 has a front end and a rear end which are opposed to each other in the longitudinal direction Y, and the second connection part 32 has a front end and a rear end which are opposed to each other in the longitudinal direction Y. In the embodiment shown in FIG. 1, the rear end of the first connection part 31 is connected to a first position of the base 21 adjacent to the first conductor crimping part 22*a*, and the front end of the first connection part 31 is connected to the rear end of the receptacle part 10. The rear end of the second connection part 32 is connected to a second position of the base 21 adjacent to the second conductor crimping part 22*b*, and the front end of the second connection part 32 is connected to the rear end of the receptacle part 10.

The receptacle part 10, as shown in FIG. 1, includes a bottom 11 and a pair of elastic contact parts 12. An insert cavity 10*a* is formed between the bottom 11 and the elastic contact parts 12 to receive the plug inserted into the receptacle part 10. The elastic contact parts 12 are adapted to elastically electrically contact the plug inserted into the receptacle part 10. The bottom 11 has a left side and a right side which are opposed to each other in the lateral direction X. The bottom 11 further has a front end and a rear end which are opposed to each other in the longitudinal direction Y. The pair of elastic contact parts 12 are connected to the left side and the right side of the bottom 11, respectively. The elastic latch 13 is connected to the rear end of the bottom 11. The insert cavity 10*a* has a front opening 101 located at the front end of the bottom 11, so that the plug is adapted to be inserted into the insert cavity 10*a* in the longitudinal direction Y from the front opening 101.

As shown in FIG. 1, the front end of the first connection part 31 is connected to one of the left side and the right side of the bottom 11, and the front end of the second connection part 32 is connected to the other one of the left side and the right side of the bottom 11. The first connection part 31 and the second connection part 32 both flatly extend from the crimping part 20 to the receptacle part 10 in the longitudinal direction Y.

In the embodiment shown in FIG. 1, each of the elastic contact parts 12 is an elastic contact piece that is crimped into an arc shape. The elastic contact piece is adapted to elastically electrically contact with a top surface of the plug inserted into the receptacle part 10.

As shown in FIG. 1, an elastic lock 14 projecting towards an inner portion of the insert cavity 10*a* is formed on the elastic latch 13. The elastic lock 14 is adapted to latch into a recess on a front end surface of the plug inserted into the receptacle part 10.

It should be appreciated for those skilled in this art that the above embodiments are intended to be illustrative, modifications may be made to the above embodiments by those skilled in the art, and structures described in various embodiments may be freely combined without having structural and principle conflict, so that more conductive terminals and connector assemblies will be achieved on the basis of solving the technical problem of the present disclosure. Although some embodiments of the general concept of the present disclosure have been shown and described, it would be appreciated by those skilled in the art that modifications may be made to these embodiments without departing from the principle and spirit of the present disclosure, the scope of which is defined in the claims and their equivalents.

What is claimed is:

1. A connection terminal, comprising:

a receptacle part disposed at a first end of the connection terminal in a longitudinal direction and configured to mate with a plug inserted into the receptacle part;

a crimping part disposed at a second end of the connection terminal in the longitudinal direction and configured to be crimped on a wire, the crimping part includes a conductor crimping part adapted to be crimped on a conductor of the wire and an outer layer crimping part adapted to be crimped on an outer layer of the wire, the conductor crimping part includes a first conductor crimping part and a second conductor crimping part which are spaced from each other by an interval in a lateral direction perpendicular to the longitudinal direction; and a connection part connected between the receptacle part and the crimping part, the receptacle part includes an elastic latch adapted to lock the plug inserted into the receptacle part and located at a rear end of the receptacle part close to the crimping part, the elastic latch is positioned between the first conductor crimping part and the second conductor crimping part in the lateral direction.

2. The connection terminal of claim 1, wherein the connection part includes a first connection part and a second connection part which are arranged at a pair of opposite sides of the receptacle part in the lateral direction.

3. The connection terminal of claim 2, wherein the first conductor crimping part, the second conductor crimping part, and the elastic latch are positioned between the first connection part and the second connection part in the lateral direction.

4. The connection terminal of claim 3, wherein the second connection part is positioned between the second conductor crimping part and the outer layer crimping part in the lateral direction.

5. The connection terminal of claim 4, wherein the crimping part includes a base extending in the lateral direction, the base connecting the first conductor crimping part, the second conductor crimping part, and the outer layer crimping part.

6. The connection terminal of claim 5, wherein the first connection part has a front end and a rear end which are opposite to each other in the longitudinal direction and the second connection part has a front end and a rear end which are opposite to each other in the longitudinal direction.

7. The connection terminal of claim 6, wherein the rear end of the first connection part is connected to a first position of the base adjacent to the first conductor crimping part and the front end of the first connection part is connected to the rear end of the receptacle part.

8. The connection terminal of claim 7, wherein the rear end of the second connection part is connected to a second position of the base adjacent to the second conductor crimping part and the front end of the second connection part is connected to the rear end of the receptacle part.

9. The connection terminal of claim 8, wherein the base has a pair of opposite sides in the longitudinal direction, the first conductor crimping part has a pair of first conductor crimping wings located on the opposite sides of the base, the second conductor crimping part has a pair of second conductor crimping wings located on the opposite sides of the base, and the outer layer crimping part has a pair of outer layer crimping wings located on the opposite sides of the base.

10. The connection terminal of claim 9, wherein the receptacle part includes a bottom and a pair of elastic contact parts, an insert cavity is formed between the bottom and the elastic contact parts to receive the plug inserted into the receptacle part.

11. The connection terminal of claim 10, wherein the elastic contact parts are adapted to elastically electrically contact with the plug inserted into the receptacle part.

12. The connection terminal of claim 11, wherein the bottom has a left side and a right side which are opposite to each other in the lateral direction, and the bottom has a front end and a rear end which are opposite to each other in the longitudinal direction.

13. The connection terminal of claim 12, wherein the pair of elastic contact parts are respectively connected to the left side and the right side of the bottom, and the elastic latch is connected to the rear end of the bottom.

14. The connection terminal of claim 13, wherein the insert cavity has a front opening located at the front end of the bottom, the plug is adapted to be inserted into the insert cavity in the longitudinal direction from the front opening.

15. The connection terminal of claim 14, wherein each of the elastic contact parts is an elastic contact piece that is crimped into an arc shape and adapted to elastically electrically contact with a top surface of the plug inserted into the receptacle part.

16. The connection terminal of claim 14, wherein an elastic lock projecting towards an inner portion of the insert cavity is formed on the elastic latch, the elastic lock is adapted to latch into a recess on a front end surface of the plug inserted into the receptacle part.

17. The connection terminal of claim 14, wherein the front end of the first connection part is connected to one of the left side and the right side of the bottom, and the front end of the second connection part is connected to the other one of the left side and the right side of the bottom.

18. The connection terminal of claim 3, wherein the first connection part and the second connection part both flatly extend from the crimping part to the receptacle part in the longitudinal direction.

19. The connection terminal of claim 1, wherein the connection terminal is an integrated piece formed of a single metal sheet.

* * * * *